US009340737B2

(12) United States Patent
Andrade Moreno

(10) Patent No.: US 9,340,737 B2
(45) Date of Patent: May 17, 2016

(54) LIQUID FUEL

(75) Inventor: Luis David Andrade Moreno, Perales del Rio Madrid (ES)

(73) Assignee: SPARKNUM INTERNATIONAL, S.L., Alcobendas (ES)

( * ) Notice: Subject to any disclaimer, the term of this patent is extended or adjusted under 35 U.S.C. 154(b) by 261 days.

(21) Appl. No.: 14/001,394

(22) PCT Filed: Feb. 24, 2011

(86) PCT No.: PCT/ES2011/000048

§ 371 (c)(1),
(2), (4) Date: Aug. 23, 2013

(87) PCT Pub. No.: WO2012/127068

PCT Pub. Date: Sep. 27, 2012

(65) Prior Publication Data

US 2013/0331621 A1 Dec. 12, 2013

(51) Int. Cl.

| | |
|---|---|
| ***C10L 1/04*** | (2006.01) |
| ***C10L 1/06*** | (2006.01) |
| ***C10L 1/16*** | (2006.01) |

(52) U.S. Cl.

CPC ... *C10L 1/04* (2013.01); *C10L 1/06* (2013.01); *C10L 1/1608* (2013.01); *C10L 2200/04* (2013.01); *C10L 2270/023* (2013.01)

(58) Field of Classification Search

CPC ..... C10L 1/04; C10L 1/1608; C10L 1/06; C10L 2270/023; C10L 2200/04

USPC ..... 585/14; 44/300

See application file for complete search history.

(56) References Cited

U.S. PATENT DOCUMENTS 5,208,402 A * 5/1993 Wilson ..... 585/1

FOREIGN PATENT DOCUMENTS

| | | |
|---|---|---|
| AU | 551451 | 2/1984 |
| JP | 59004689 | 6/1982 |
| JP | 59078292 | 7/1982 |
| JP | 57139185 | 8/1982 |
| JP | 1131299 | 9/1989 |

OTHER PUBLICATIONS

International Search Report for PCT/ES2011/000048, English translation attached to original, Both completed by the Spanish Patent Office on Jul. 8, 2011, All together 5 Pages.

* cited by examiner

*Primary Examiner* — In Suk Bullock
*Assistant Examiner* — Philip Louie
(74) *Attorney, Agent, or Firm* — Brooks Kushman P.C.

(57) ABSTRACT

A liquid fuel formed by the mixture of toluene, meta-xylene and n-hexane, in proportions of between 50 and 70% of toluene, between 10 and 20% of meta-xylene and between 20 and 30% of n-hexane.

1 Claim, No Drawings

LIQUID FUEL

CROSS-REFFERENCE TO RELATED APPLICATION

This application is the U.S. national phase of PCT Application No. PCT/ES2011/000048 filed on Feb. 24, 2011, the disclosure of which is incorporated in its entirety by reference herein.

FIELD OF TECHNOLOGY

The present invention relates to a liquid fuel and more particularly to the so-called gasolines used as fuel for internal combustion engines with spark ignition. Gasoline is obtained by mixing light liquid hydrocarbons obtained from crude oil, after various petrochemical processes carried out at a refinery.

There is a variety of hydrocarbons grouped into families, among which are the alkanes, which are hydrocarbons having carbon atoms joined by single covalent bonds. Most oil hydrocarbons belong to that family.

In general, gasoline is obtained in a refinery from straight run naphtha, which is the lightest liquid fraction from oil (excluding gases). Naphtha is also obtained from the conversion of heavy oil fractions (vacuum gasoil) in process units known as FCC (fluid catalytic cracking) or hydrocracking units. Gasoline is a mixture of hundreds of individual hydrocarbons from $C_4$ (butanes and butenes) to $C_{11}$ such as, for example, methylnaphthalene.

To this mixture of hundreds of individual hydrocarbons it is necessary to add another series of additives that enable the proper octane index and the necessary lubrication levels to be obtained.

On the other hand, the oil refining and reforming processes generate a range of chemicals as by-products that have an uneven usage and, therefore, varying degrees of demand. Furthermore, this degree of demand varies with time as the manufacturing processes that employ such by-products evolve.

For example, among the range of by-products obtained there are solvents such as xylene and hexane that, for years, have been used, for example, for the production of varnishes and paints but, currently, have seen their demand substantially reduced as manufacturing processes for varnishes and paints have evolved.

Even though the demand for these solvents has been greatly reduced, the oil refining process still produces these solvents, and therefore their price has been greatly diminished.

The object of the present invention is a new, optimized gasoline formulation which uses these by-products, obtaining a product with an optimum production cost due to the reduced number of components, the cost of such components, and the simplicity of the manufacturing process.

Prior Art

From Japanese Patent JP 59078292 it is known how to obtain a gasoline by blending benzene, toluene and xylene and a low flash point component such as normal-hexane or isooctane to reach 98% volume, filling up to 100% volume with a kerosene component.

Japanese Patent JP 59004689 also describes how to obtain a gasoline substitute that, as in the previous case, is obtained by mixing benzene, toluene and xylene to which a low flash point component such as n-hexane or cyclohexane is also added to reach 98% volume, filling the remaining volume with a heavy oil component.

Japanese Patent JP 1131299 relates to a fuel formed by blending 10-48 volume% of benzene, 72-22% volume of a compound selected from toluene, xylene and an aromatic hydrocarbon containing blends, and 18-30% volume of saturated hydrocarbons such as pentane, hexane or heptane.

OBJECT OF THE INVENTION

According to the present invention a new gasoline formula is advocated, whereby only three products are used, which are:

toluene
meta-xylene and
n-hexane

The blend of these three single products, in percentages to be detailed below, allows a gasoline with a 99 octane rating to be obtained.

toluene is the common name for methylbenzene. It is present in crude oil and in the tolu tree and while it may be produced during the production of gasoline and other fuels, the most common manufacturing process, being the least expensive, is the cyclodehydrogenation of n-heptane in the presence of catalysts, via methylheptane.

Meta-xylene and n-hexane are chemicals that are obtained within the normal crude oil refining and reforming process.

Meta-xylene is an isomer of xylene, having the methyl groups at the meta position, i.e.: it is dimethyl-1,3-benzene, and its molecular formula is $C_8H_{10}$. It is obtained from crude oil; by refining and reforming the latter, a mixture of xylene isomers (meta, ortho, and para) is obtained. The "ortho" isomer is separated by fractional distillation, and when the distillate is cooled, the "meta" isomer is separated by fractional crystallization.

In the present invention, it is essential to use the meta-xylene isomer instead of the xylene already used in other formulations.

N-hexane is an isomer of hexane. It is an alkane aliphatic hydrocarbon whose molecular formula is $C_6H_{14}$. It is obtained by fractional distillation of crude oil.

According to the present invention the volume percentages of these three components are:

| | |
|---|---|
| toluene | 50-70% volume |
| meta-xylene | 10-20% volume |
| n-hexane | 20-30% volume |

Preferably, the volume percentage of these three components will be between the following values:

| | |
|---|---|
| toluene | 60% volume |
| meta-xylene | 10% volume |
| n-hexane | 30% volume |

With all three components 100% of the volume is achieved, although, and by no means changing the essence of the invention, it is envisaged that to the mixture of these three basic components the usual additives, such as those aimed at improving the rate of lubrication, may be added in minimal percentage amounts.

The manufacturing process is very simple because it only requires the blending of the three components, without any other special conditions.

The following gives three examples of gasoline obtained according to the invention, for use in normal climates, in extreme cold weather, and as a mixture that enhances the octane value.

EXAMPLE 1

Gasoline for Normal Climates

The volume percentages are:

| | |
|---|---|
| toluene | 60% volume |
| meta-xylene | 10% volume |
| n-hexane | 30% volume |

EXAMPLE 2

Gasoline for Extreme Hot Weather

The volume percentages are:

| | |
|---|---|
| toluene | 50% volume |
| meta-xylene | 20% volume |
| n-hexane | 30% volume |

EXAMPLE 3

Formula for Octane Value Enhancement

The volume percentages are:

| | |
|---|---|
| toluene | 70% volume |
| meta-xylene | 10% volume |
| n-hexane | 20% volume |

This formula can reach octane ratings between 98 and 100.

According to all the above and as per the present invention, an optimized formulation for a gasoline is obtained with an optimum production cost, both because of the greatly reduced number of components and the cost itself of such components, and the simplicity of the manufacturing process, which only requires the simple blending of the components.

The invention claimed is:

1. A liquid fuel consisting of 60% toluene, 10% meta-xylene, and 30% n-hexane by volume.

* * * * *